US006652234B2

(12) United States Patent
MacCuaig

(10) Patent No.: US 6,652,234 B2
(45) Date of Patent: Nov. 25, 2003

(54) EASY INSTALL CEILING FAN BLADE

(76) Inventor: Marion H. MacCuaig, 604 Woodcrest La. East, Palm Desert, CA (US) 92260

( * ) Notice: Subject to any disclaimer, the term of this patent is extended or adjusted under 35 U.S.C. 154(b) by 6 days.

(21) Appl. No.: 10/131,218

(22) Filed: Apr. 25, 2002

(65) Prior Publication Data

US 2003/0202881 A1 Oct. 30, 2003

(51) Int. Cl.[7] ..... F04D 29/36
(52) U.S. Cl. ..... 416/62; 416/210 R
(58) Field of Search ..... 416/62, 210 R, 416/207, 170 R, 5, 224, 229, 230, 23, 146 R

(56) References Cited

U.S. PATENT DOCUMENTS

| | | | | | |
|---|---|---|---|---|---|
| 871,729 | A | * | 11/1907 | McChord, Jr. | |
| 1,055,947 | A | * | 3/1913 | Schwartzberg | |
| 2,014,032 | A | * | 9/1935 | Sharpe et al. | |
| 4,662,823 | A | * | 5/1987 | Cooke | 416/23 |
| 4,738,594 | A | * | 4/1988 | Sato et al. | 416/224 |
| 4,832,572 | A | | 5/1989 | Prucha et al. | |
| 4,892,460 | A | * | 1/1990 | Volk | 416/62 |
| 5,470,205 | A | | 11/1995 | Conklin, Jr. | |
| 5,516,264 | A | | 5/1996 | Anetrini | |
| 5,564,900 | A | | 10/1996 | McAuley | |
| 5,591,005 | A | | 1/1997 | McCready | |
| 5,591,006 | A | | 1/1997 | DeMeo et al. | |
| 6,155,787 | A | | 12/2000 | Hodgkins, Jr. | |
| 6,183,201 | B1 | * | 2/2001 | Maby | 416/170 R |
| D451,997 | S | | 12/2001 | Schwartz | |
| 6,352,411 | B1 | | 3/2002 | Bucher et al. | |

* cited by examiner

*Primary Examiner*—Edward K. Look
*Assistant Examiner*—J. M. McAleenan
(74) *Attorney, Agent, or Firm*—Richard C. Litman

(57) ABSTRACT

A decoratively designed ceiling fan blade having a front surface, back surface, an outer end, an inner end and two opposing sides. Two C-shaped brackets are attached to the back surface of the blade. Each bracket has a set screw. When in use, one decorative blade is mounted onto each of an existing ceiling fan's blades. Each existing blade is inserted inside the brackets along the back surface of the decorative blade. The set screw is used to secure the decorative blades to the existing blades.

8 Claims, 4 Drawing Sheets

EASY INSTALL CEILING FAN BLADE

BACKGROUND OF THE INVENTION

1. Field of the Invention

The present invention relates to ceiling fans, in particular to decoratively designed ceiling fan blades which are easy to install to existing ceiling fan blades.

2. Description of the Related Art

Ceiling fans are well known devices that function to circulate air and decorate many rooms across the world. Ceiling fans generally have a long operational life span and once installed, will ordinarily last for many years. Unfortunately, over time styles and home decorating choices tend to change, leaving the home owner with few fashionable options short of completely replacing the fan.

One option for updating the look of a ceiling fan is to cover the blades with a fan blade cover. The related art is replete with a multitude of fan blade cover designs. For example, U.S. Pat. Nos. 4,832,572 to Prucha et al., 5,470,205 to Conklin, Jr., 5,516,264 to Anetrini, 5,564,900 to McAuley, 5,591,005 to McCready, and 5,591,006 to DeMeo et al. all teach different methods of securing decorative coverings to ceiling fan blades. These coverings do not, however, change the shape or the function of the blades, as does the present invention, and are therefore limited in their ability to change the overall appearance of a ceiling fan.

A second approach to updating ceiling fan design without completely replacing the fan itself is to remove and replace the fan's blades. Replacing a ceiling fan's blades can be a difficult process. The blades must not only be securely attached to the fan motor, they must also be carefully balanced. This process can be especially tiresome due to the fact that the installer must be positioned on a ladder or in some other elevated position and the work must be preformed above the head of the installer. Special tools must also frequently be used to remove the blades.

U.S. Pat. Nos. 6,155,787 to Hodgkins, Jr. and 6,352,411 to Bucher et al. teach interchangeable ceiling fan blade systems and quick install blade arms for ceiling fans. These systems alleviate some of the above mentioned problems associated with fan blade replacement but, unlike the present invention, the '787, and '411 patents teach the removal and replacement of the original fan blades, a step not required by the present invention.

U.S. Pat. No. D451,997 to Schwartz teaches a ceiling fan design wherein each of the five fan blades resembles a palm frond. The '997 design differs from the present invention because it contains a border around each palm frond and the fronds are shaped differently. The '997 design also lacks the attachment brackets of the present invention.

None of the above inventions and patents, taken either singularly or in combination, is seen to describe the instant invention as claimed. Thus an easy install ceiling fan blade solving the aforementioned problems is desired.

SUMMARY OF THE INVENTION

The present invention is a decoratively designed easy to install ceiling fan blade that attaches directly to the existing blades of a ceiling fan. Each blade has a body with a front surface, back surface, inner edge, outer edge and two opposing side edges. The body may be constructed in a number of different shapes ranging from traditional blades to a stemless spade type shape. The front surface is decorative, and two brackets are attached to the back surface. The brackets are designed to allow a fan blade to slide between the brackets and the back surface of the body. A set screw located on each bracket secures the existing blade to the easy install blade.

The easy install fan blades can come in a variety of shapes and styles bounded only by a designer's imagination. Palm frond type ceiling fans have become more popular in recent years. Due to this fact the preferred embodiment of the easy install ceiling fan blade is shaped to resemble palm fronds to give an existing ceiling fan a tropical look.

Accordingly, it is a principal object of the invention to provide an easy to install ceiling fan blade that is attachable to an existing ceiling fan blade.

It is another object of the invention to provide an easy to install ceiling fan blade that can be attached to an existing ceiling fan blade without the need for tools.

It is a further object of the invention to provide an easy to install ceiling fan blade that will change the appearance of an existing ceiling fan.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
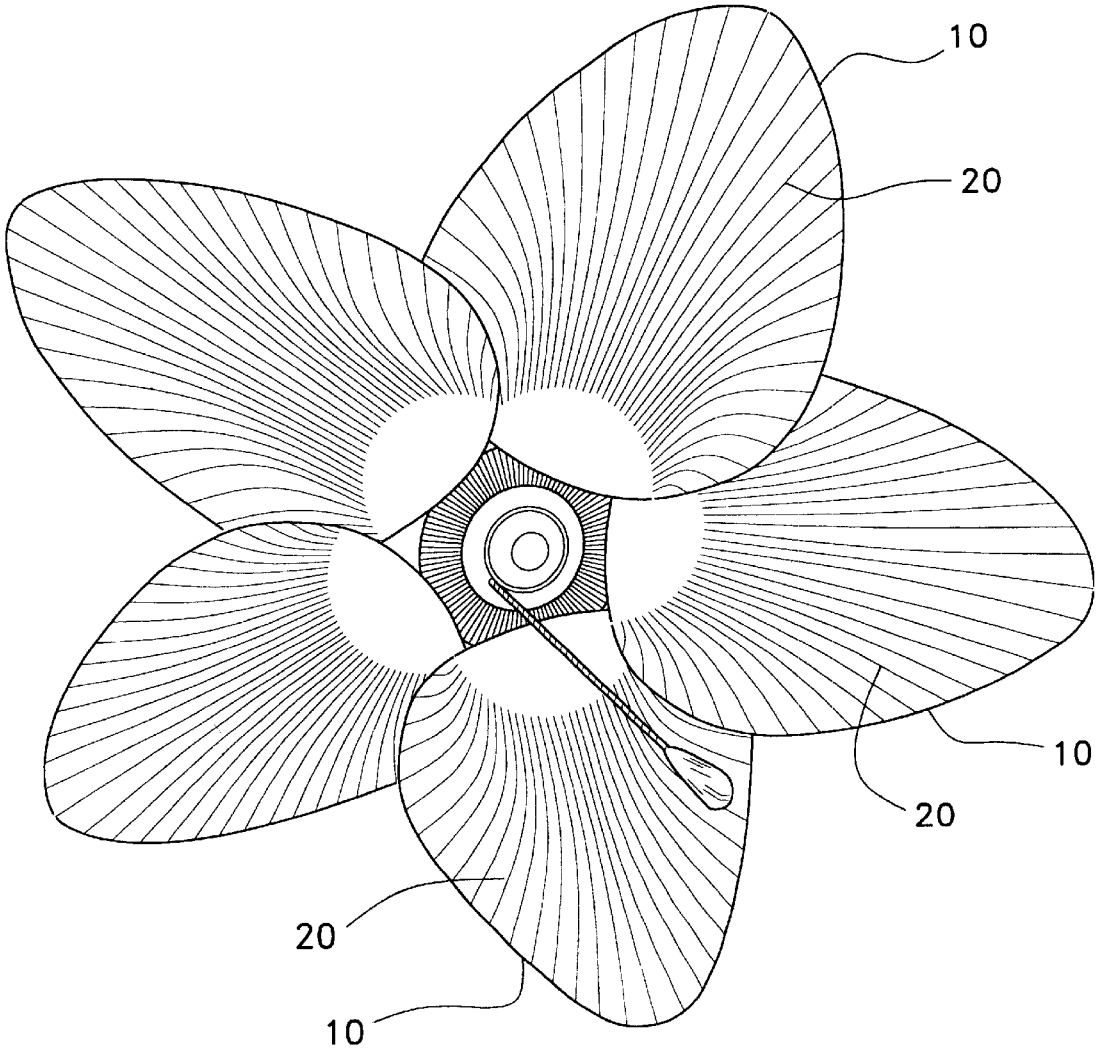
FIG. 1 is an environmental perspective view of several easy install ceiling fan blades according to the present invention installed on a ceiling fan.

As illustrated in FIG. 1, the present invention is a decoratively designed easy install ceiling fan blade 10 that can be attached directly to an existing ceiling fan blade. Each easy install blade 10 is flat and has a decorative front surface, a back surface, an outer end, an inner end and two opposing sides. The preferred embodiment of the blade 10 is generally shaped like a stemless spade. The blades are preferably composed of acrylonitrile-butadiene-styrene (ABS) plastic, which gives the blades high strength as well as light weight. Each blade is constructed to exacting tolerances for size, shape and weight to insure proper balancing once attached to a fan.

The front surface of each blade is textured with a plurality of veins 20. The combination of the veins 20 and the spade like shape makes each blade 10 resemble a palm frond. When one easy install blade 10, as shown in FIG. 1, is installed on each blade of a ceiling fan, the entire visual effect of a ceiling fan is changed. In so doing a traditional ceiling fan is altered to resemble a palm frond type tropical ceiling fan.

The presence of the veins 20 and the close proximity of the blades 10 to one another alters the flow of air from the fan. Rather than flowing towards the ceiling or the floor as in most ceiling fans, the palm frond type blades 10 direct the air horizontally. This fact allows the fan to circulate air without disturbing objects below.

Figure 2:
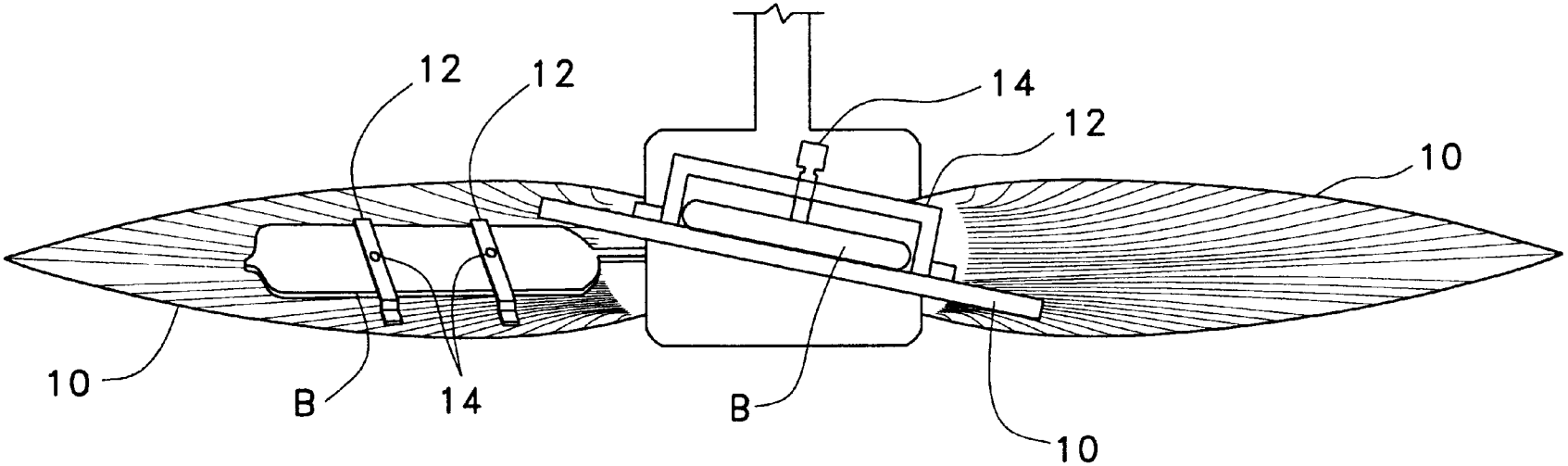
FIG. 2 is a side view of easy install ceiling fan blades according to the present invention attached to an existing ceiling fan.

FIG. 2 illustrates a side view of several easy install blades 10 attached to an existing ceiling fan. Attached to the back surface of each easy install blade 10 is a pair of roughly C-shaped brackets 12. The fan blades B of the existing ceiling fan are positioned between the brackets 12 and the back surface of each easy install blade 10. A set screw 14 located in each bracket 12 is used to hold the easy install blades 10 in position on the existing fan blades B.

Figure 3:
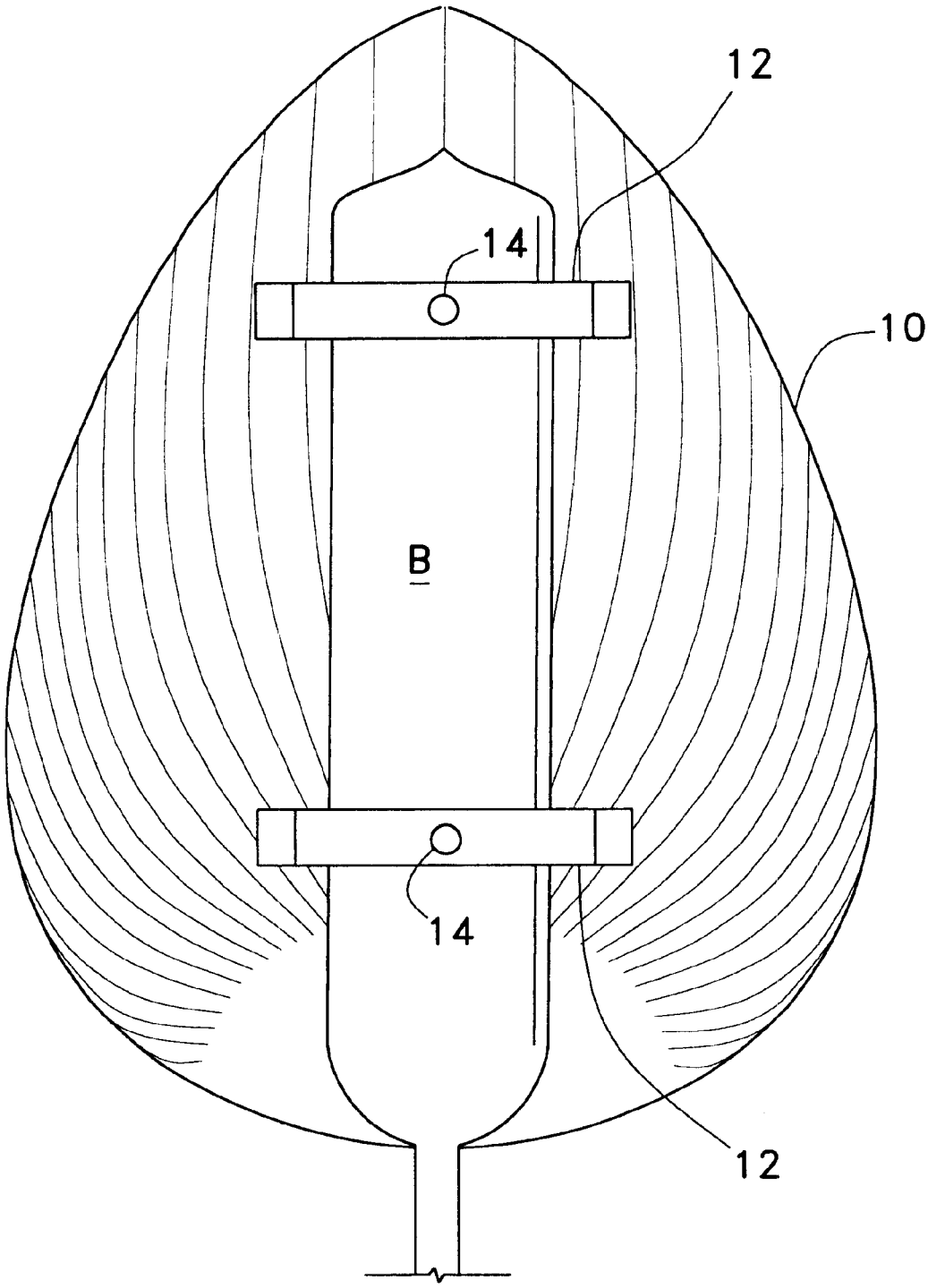
FIG. 3 is a rear view of an easy install blade according to the present invention attached to a conventional fan blade.

FIG. 3 illustrates a view of the back surface of the easy install ceiling fan blade 10. Each bracket 12 is designed to be slightly wider than the existing fan blades B and has a centrally located set screw 14. The set screw 14 threadably engages the bracket 12 and is used to secure the decorative blade 10 to the existing fan blade B.

Figure 4:
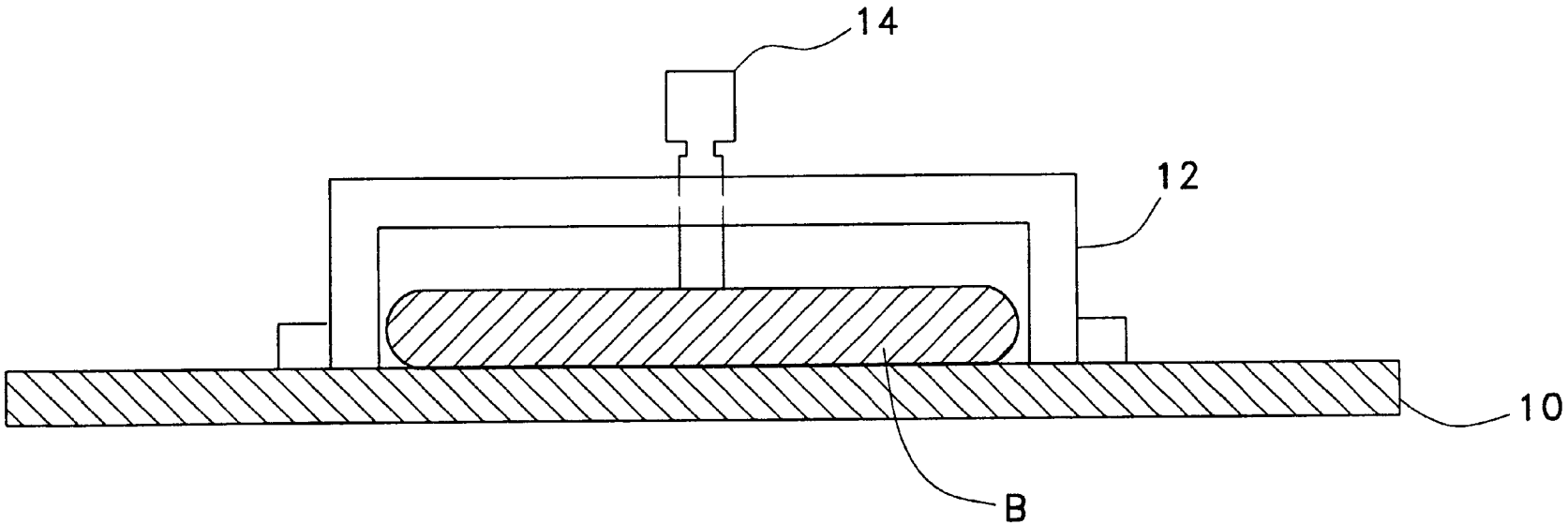
FIG. 4 is a sectional view of an easy install blade according to the present invention attached to a conventional blade.

FIG. 4 illustrates a sectional view of the attachment between a bracket 12, a blade 10 and an existing blade B. The set screw 14 extends through the bracket 12 and secures the blade 10 to the existing fan blade B.

It is to be understood that the present invention is not limited to the embodiment described above, but encompasses any and all embodiments within the scope of the following claims.

I claim:

1. An easy install ceiling fan blade, comprising:

a flat body having a front surface, a back surface, an outer end, and inner end and two opposing sides;

two brackets disposed upon said back surface; and two set screws, one said set screw being disposed in each said bracket;

wherein said brackets and said set screws are adapted to secure said body to an existing ceiling fan blade.

2. An easy install ceiling fan blade as in claim 1, wherein:

said body is generally shaped like a spade without a stem; and said front surface is textured to resemble a palm frond.

3. An easy install ceiling fan blade as in claim 1, wherein:

said body is made of acrylonitrile-butadiene-styrene plastic.

4. An easy install ceiling fan blade as in claim 1, wherein:

each said bracket is substantially C-shaped; and one said set screw threadably engages the center of each said bracket.

5. A ceiling fan in combination with easy install ceiling fan blades, comprising:

a ceiling fan having a plurality of fixed blades;

an easy install ceiling fan blade attached to each of said fixed blades, each easy install ceiling blade comprising:

a flat body having a front surface, a back surface, an outer end, and inner end and two opposing sides;

two brackets disposed upon said back surface; and two set screws, one said set screw being disposed in each said bracket;

wherein said brackets and said bolts are adapted to secure said body to an existing ceiling fan blade.

6. A ceiling fan in combination with easy install ceiling fan blades as in claim 5, wherein:

said body is generally shaped like a spade without a stem; and said front surface is textured to resemble a palm frond.

7. A ceiling fan in combination with easy install ceiling fan blades as in claim 5, wherein:

said body is made of acrylonitrile-butadiene-styrene plastic.

8. A ceiling fan in combination with easy install ceiling fan blades as in claim 5, wherein:

said brackets are substantially C-shaped; and one of each said set screw threadably engages the center of each said bracket.

* * * * *